US007372245B2

(12) United States Patent
Ito et al.

(10) Patent No.: US 7,372,245 B2
(45) **Date of Patent: *May 13, 2008**

(54) SEMICONDUCTOR INTEGRATED CIRCUIT

(75) Inventors: Takayasu Ito, Kodaira (JP); Mitsuru Hiraki, Kodaira (JP); Masashi Horiguchi, Kogainei (JP); Tadashi Kameyama, Hannou (JP)

(73) Assignee: Renesas Technology Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/727,559

(22) Filed: Mar. 27, 2007

(65) Prior Publication Data

US 2007/0170907 A1 Jul. 26, 2007

Related U.S. Application Data

(63) Continuation of application No. 11/390,276, filed on Mar. 28, 2006, now Pat. No. 7,205,755.

(30) Foreign Application Priority Data

Mar. 31, 2005 (JP) ..... 2005-100526

(51) Int. Cl.
*G05F 3/16* (2006.01)
*G05F 3/20* (2006.01)

(52) U.S. Cl. ..... 323/316

(58) Field of Classification Search ..... 323/315, 323/316, 317, 907; 324/721
See application file for complete search history.

(56) References Cited

U.S. PATENT DOCUMENTS 3,962,592 A * 6/1976 Thommen et al. ..... 327/538
4,292,583 A 9/1981 Hoeft ..... 323/316

FOREIGN PATENT DOCUMENTS

JP 07-218347 8/1995
JP 10-009967 1/1998

* cited by examiner

*Primary Examiner*—Gary L. Laxton
(74) *Attorney, Agent, or Firm*—Miles & Stockbridge P.C.

(57) ABSTRACT

A difference between both emitter voltages of a first transistor having an emitter through which a first current flows, and at least one second transistor having an emitter through which such a second current as to reach a current density thereof smaller than that of the emitter of the first transistor flows, is applied across a first resistor. A second resistor is provided between the emitter of the second transistor and a circuit's ground potential. A third resistor and a fourth resistor are respectively provided between collectors of the first and second transistors and a power supply voltage. Such an output voltage that a collector voltage of the first transistor and a collector voltage of the second transistor become equal is formed in response to the collector voltage of the first transistor and the collector voltage of the second transistor and supplied to bases of the first and second transistors in common. A temperature sense voltage is formed from a connecting point of the first and second resistors.

13 Claims, 15 Drawing Sheets

SEMICONDUCTOR INTEGRATED CIRCUIT

CROSS-REFERENCE TO RELATED APPLICATION

This application is a continuation of application Ser. No. 11/390,276 filed Mar. 28, 2006 now U.S. Pat. No. 7,205,755.

The present application claims priority from Japanese patent application No. 2005-100526 filed on Mar. 31, 2005, the content of which is hereby incorporated by reference into this application.

BACKGROUND OF THE INVENTION

The present invention relates to a semiconductor integrated circuit, and particularly to a technique effective when applied to a semiconductor integrated circuit equipped with a temperature sensor circuit.

As an example of a temperature detector or sensor circuit using a temperature coefficient of a forward voltage of a pn junction based on a bandgap, there has been known a patent document 1 (Japanese Unexamined Patent Publication No. Hei 07(1995)-218347). As an example illustrative of a reference voltage circuit and a temperature sensor circuit using the same, there has been known a patent document 2 (Japanese Unexamined Patent Publication No. 10(1998)-009967).

SUMMARY OF THE INVENTION

The patent documents 1 and 2 are disclosed assuming that a temperature sense signal is compared with a reference voltage having no temperature dependence. Therefore, a temperature gradient of the temperature sense signal is uniquely determined by a resistance ratio between resistive elements set so as to cancel the temperature dependence. It is thus not possible to arbitrarily set the temperature gradient. There is no idea that a temperature sense signal is outputted from outside a semiconductor integrated circuit, and there is a limit to its uses. When the temperature sensor circuit is mounted in a CMOS integrated circuit, an input offset of an operational amplifier configured by a CMOS circuit, which performs amplification/feedback, varies greatly, and a trimming circuit for correcting it is required. From the viewpoint of these, the usability thereof becomes poor where the temperature sensor circuit is mounted in the CMOS integrated circuit in particular.

An object of the present invention is to provide a semiconductor integrated circuit equipped with a temperature sensor circuit suitable for a CMOS process and capable of setting an arbitrary temperature gradient. The above, other objects and novel features of the present invention will become apparent from the description of the present specification and the accompanying drawings.

A summary of a representative one of the inventions disclosed in the present application will briefly be explained as follows: A difference between both emitter voltages of a first transistor having an emitter through which a first current flows, and each of second transistors each having an emitter through which such a second current as to reach a current density thereof smaller than that of the emitter of the first transistor flows, is applied across a first resistor. A second resistor is provided between the emitter of the second transistor and a circuit's ground potential. A third resistor and a fourth resistor are respectively provided between collectors of the first and second transistors and a power supply voltage. Such an output voltage that a collector voltage of the first transistor and a collector voltage of the second transistor become equal is formed in response to the collector voltage of the first transistor and the collector voltage of the second transistor and supplied to bases of the first and second transistors in common. A temperature sense voltage is formed from a connecting point of the first and second resistors.

A temperature sense signal resistant to offset of a differential amplifier circuit and having an arbitrary temperature gradient is obtained and a circuit can be configured in a CMOS process.

DETAILED DESCRIPTION OF THE PREFERRED EMBODIMENTS

Figure 1:
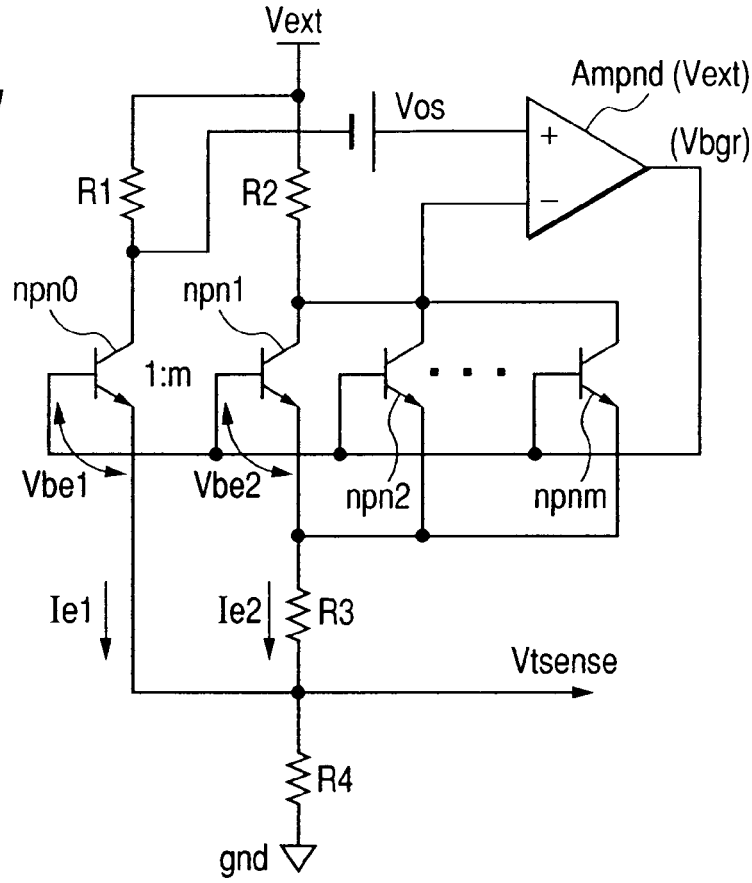
FIG. 1 is a circuit diagram showing one embodiment of a temperature sensor circuit according to the present invention.

A circuit diagram of one embodiment of a temperature detector or sensor circuit according to the present invention is shown in FIG. 1. Respective circuit elements shown in the same figure are formed on one semiconductor substrate like monocrystalline silicon together with other circuit elements not shown in the figure.

The temperature sensor circuit according to the present embodiment comprises a bandgap generating section and an amplification/feedback section. The bandgap generating section comprises npn type bipolar transistors npn0 and npn1 through npnm, and resistors R1 through R4. The transistors npn0 and npn1 through npnm are constituted of transistors identical in size to one another. The transistors npn1 through npnm are connected in parallel. Thus, these transistors npn0 and npn1 through npnm respectively constitute a first transistor comprised of the transistor npn0, and second transistors each formed in a size equal to m times the size of the first transistor. That is, when the same emitter currents Ie1 and Ie2 are caused to flow through the first transistor npn0 and the second transistors npn1 through npnm, an emitter current density of the first transistor npn0 is set large so as to reach m times the emitter current density of each of the second transistors npn through npnm in correspondence with such a size ratio as described above. On the contrary, the emitter current densities of the second transistors npn1 through npnm are set small to 1/m of the emitter current density of the first transistor.

In association with the difference between the emitter current densities of the transistors, base-to-emitter voltages Vbe1 and Vbe2 of the first transistor npn0 and second transistors npn1 through npnm are held in such a relationship that the base-to-emitter voltage Vbe1 of the first transistor npn0 is increased by a constant voltage ΔVbe corresponding to a silicon bandgap. The bases of the first transistor npn0 and second transistors npn1 through npnm are connected in common. The emitters of the second transistors npn1 through npnm are connected to one end of the resistor R3, and the other end of the resistor R3 is connected to the emitter of the first transitory npn0. Thus, the constant voltage ΔVbe is applied across the resistor R3, where the corresponding constant current Ie2 is formed. The resistor R4 is provided between the emitter of the first transistor npn0 and a ground potential gnd of the circuit.

The resistors R1 and R2 formed so as to have the same resistance value are respectively provided between the collectors of the first transistor npn0 and second transistors npn1 through npnm and a power supply voltage Vext supplied from an external terminal. Collector voltages of the first transistor npn0 and second transistors npn1 through npnm are supplied to their corresponding positive-phase and negative-phase inputs (+) and (−) of a differential amplifier circuit Ampnd of a CMOS configuration, where amplification/feedback thereof is performed. That is, a signal outputted from the differential amplifier circuit Ampnd is fed back to the bases of the first transitory npn0 and second transistors npn1 through npnm.

The operation of the bandgap generating section or circuit is as follows. The base-to-emitter voltage Vbe of each bipolar transistor has a characteristic of a voltage coefficient negative relative to the temperature. If this is corrected based on the difference ΔVbe between the base-to-emitter voltages Vbe1 and Vbe2 each having a voltage coefficient positive relative to the temperature, then a reference voltage Vbgr independent on the temperature can be obtained from the output of the differential amplifier circuit Ampnd. The first transistor and second transistors shown in FIG. 1 are bipolar transistors (of areas or a number equivalent to m times) different in size. A common potential is applied to the bases of the first transistor and second transistors, and the CMOS differential amplifier circuit Ampnd is used to effect feedback in such a manner that the collector potentials of the first transistor and second transistors become equal to one another, whereby the constant voltage ΔVbe is obtained.

When the voltage outputted from the CMOS differential amplifier circuit Ampnd is assumed to be a reference voltage Vbgr in the present embodiment, the following equation (1) is established:

$$Vbgr=Vbe1+Ie\cdot R4=Vbe1+(Ie1+Ie2)\cdot R4 \quad (1)$$

Now, the emitter current Ie2 is given as expressed in the following equation (2) from the difference ΔVbe between the base-to-emitter voltages Vbe1 and Vbe2 of the first transistor npn0 and second transistors npn1 through npnm. The emitter current Ie2 is set so as to be Ie2=Ie1.

$$Ie2=\Delta Vbe/R3=kT/q\cdot\ln(m)/R3 \quad (2)$$

Substituting the above equation (2) in the equation (1) yields the following equation (3).

$$\begin{aligned} Vbgr &= Vbel + (Ie1 + Ie2)\cdot R4 \\ &= Vbe1 + 2kT/q\cdot R4/R3\cdot\ln(m) \end{aligned} \quad (3)$$

If the resistance value of the resistor R4 is set so as to cancel a negative temperature coefficient of the first term in the equation (1), then the reference voltage Vbgr independent on the temperature can be obtained. That is, the voltage generated at the resistor R4 is a voltage having such a positive temperature coefficient as to cancel the negative temperature coefficient of the Vbe2. This therefore means that a temperature detect or sense signal Vtsense having a positive temperature coefficient can be obtained by the resistor R4. From the equation (2), it is important that an error between the emitter currents Ie2 and Ie1 needs to be small to obtain a high-accuracy constant voltage ΔVbe. The temperature sense signal Vtsense and the reference voltage Vbgr are formed based on such a ΔVbe. In order to obtain the reference voltage Vbgr from the equation (3), a resistance ratio between R3 and R4 is selected so as to cancel the negative voltage coefficient of the base-to-emitter voltage Vbe2 of the first transistor, whereby the reference voltage Vbgr low in temperature dependence can be obtained.

The present embodiment does not persist in the fixedly setting of the output voltage of the differential amplifier circuit Ampnd to the temperature-compensated reference voltage Vbgr as described above. That is, the resistance value of the resistor R4 is not uniquely determined for the temperature compensation. Since the emitter current Ie1 of the first transistor npn0 and the emitter current Ie2 of each of the second transistors npnl through npnm are controlled so as to be equal to each other in the feedback circuit, the temperature sense signal Vtsense formed by the resistor R4 is determined from the following equation (4):

$$Vtsense=(Ie1+Ie2)\cdot R4=2kT/q\cdot R4/R3\cdot\ln(m) \quad (4)$$

Figure 2:
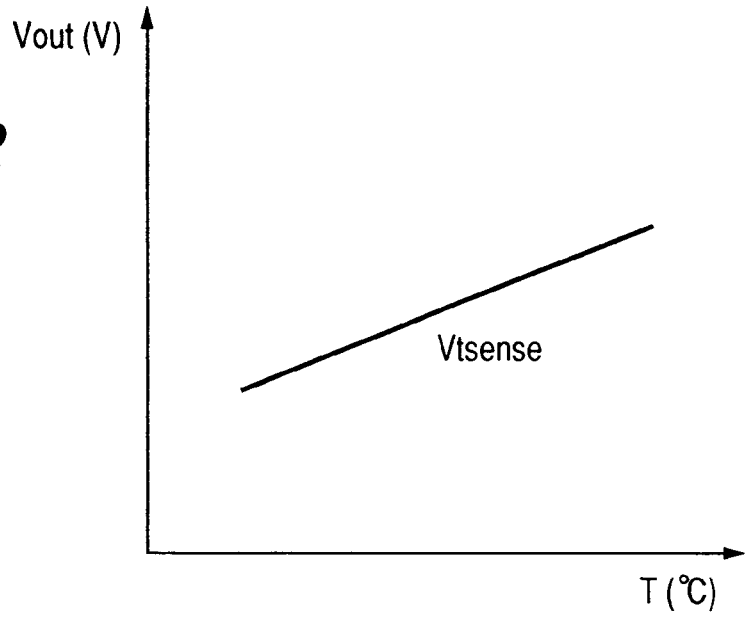
FIG. 2 is a characteristic diagram for describing the operation of the temperature sensor circuit shown in FIG. 1.

In the equation (4), the temperature sense signal Vtsense means that its temperature gradient can be set by the resistance ratio of R4/R3. That is, the temperature characteristic of the temperature sense signal Vtsense, indicating the relationship between a temperature T (° C.) and a voltage V, which is shown in FIG. 2, shows that if the resistance ratio of the resistors R4/R3 is increased, then the temperature gradient can be set large, whereas if the resistance ratio of the resistors R4/R3 is decreased in reverse, then the temperature gradient can be set small. It is thus possible to arbitrarily design it according to applications from a high-sensitivity temperature sensor circuit to a low-sensitivity temperature sensor circuit.

There may be cases where when the CMOS differential amplifier circuit is used as the differential amplifier circuit which performs amplification/feedback in such a bandgap circuit, an offset voltage Vos occurs due to variations in the threshold voltage Vth of a MOS transistor of an input section. Incidentally, Vos in FIG. 1 typically shows the offset voltage. In an ideal state, the offset voltage Vos is zero volts (0V). Thus, when the offset voltage Vos of the CMOS differential amplifier circuit Ampnd exists, the point of occurrence of the offset voltage Vos corresponds to the collector terminal of each of the first transistor npn0 and second transistors npn1 through npnm. Its influence on the emitter currents Ie1 and Ie2 is small. That is, the influence of the offset voltage Vos generated at the CMOS-configured differential amplifier circuit Ampnd due to a feedback loop of negative feedback on the reference voltage Vbgr or the temperature sense signal Vtsense can be reduced like (1/gain of bandgap generating section).

On the other hand, in the reference voltage generator as shown in the patent document 2, an offset voltage Vos is amplified by a feedback amplifier circuit and the emitter current values of two pairs of transistors, forming ΔVbe are erroneously corrected by such a feedback operation. Therefore, the circuit described in the patent document 1 is unfit for the circuit using the elements formed in the CMOS process. It is considered that when formed in the CMOS process, a circuit for trimming or the like is additionally required.

Incidentally, when the circuit shown in FIG. 1 is compared with the patent document 2, the offset voltage generated in the CMOS differential amplifier circuit is amplified even to twelve times in the case of the circuit shown in the patent document 2 where such a CMOS differential amplifier circuit that the gain is set to, for example, 12 is used. In the present invention in contrast to it, the offset voltage can be reduced to about 0.7 times or so in reverse. Thus, the circuit of FIG. 1 according to the present embodiment is capable of reducing the influence of the relatively large offset voltage Vos while using the CMOS-configured differential amplifier circuit Ampnd having the relatively large offset voltage Vos in correspondence with variations in device process, and of generating the temperature sense signal Vtsense while forming the high-accuracy reference voltage Vbgr small in temperature dependence.

The influence of the offset voltage Vos on the temperature sense signal Vtsense can be expressed in the following equations (5) and (6). In the equations, R1=R2=R, and hFE indicates current amplification gains of the first transistor and second transistors.

$$dVtsense/dVos=(R4/\alpha R)\cdot(1+2/\ln(m))\sim R4/\alpha R \quad (5)$$

$$\alpha=hFE/hFE+1 \quad (6)$$

If adequate numeric values are assumed as design values for the resistance values and current amplification gain hFE like, for example, R1=R2=500 KΩ, R3=30 kΩ and R4=150 kΩ, and hFE=10 in the equation (5), a variation is calculated as approximately 0.33. Incidentally, although variations in resistor and hFE per se due to a semiconductor manufacturing process also exist in general, the variations become small as compared with pair variations of a differential MOSFET pair of an amplifier, and the like.

Figure 3:
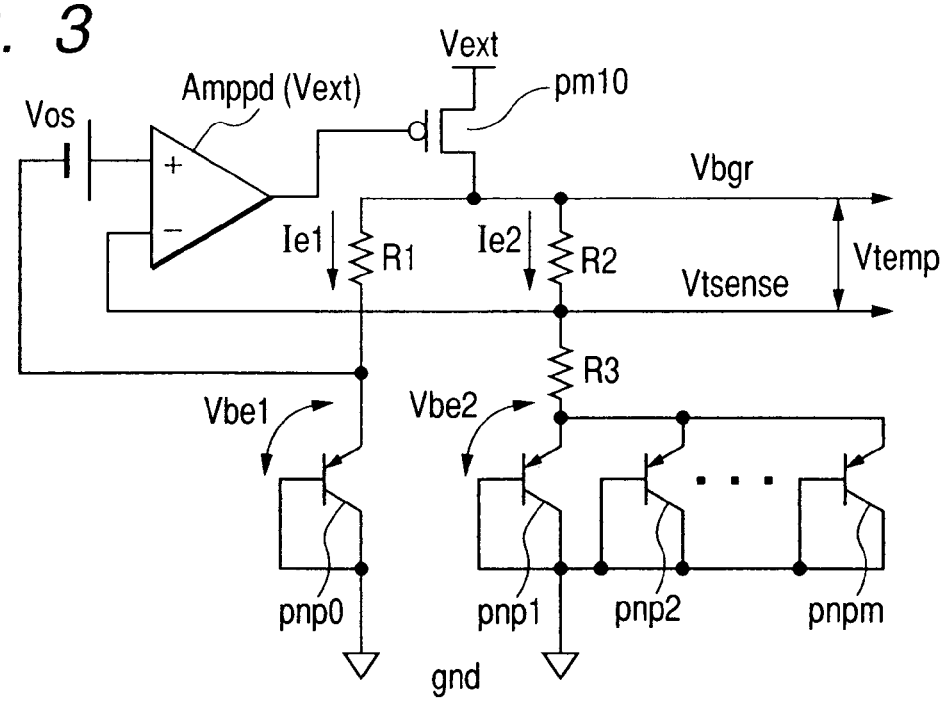
FIG. 3 is a circuit diagram illustrating another embodiment of a temperature sensor circuit according to the present invention.

A circuit diagram of another embodiment of a temperature sensor circuit according to the present invention is shown in FIG. 3. Vos shown in FIG. 3 also typically shows an offset voltage in a manner similar to Vos of FIG. 1. In the present embodiment, the present temperature sensor circuit comprises pnp type bipolar transistors pnp0 through pnpm divided in a ratio of 1:m, resistors R1 through R3, a differential amplifier circuit Amppd operated at an external power supply voltage Vext, and a P channel type driver MOSFET pm10. In the present embodiment, the transistor pnp0 is used as a third transistor. The transistors pnp1 through pnpm set to the same size as the third transistor are connected in parallel in like manner and used as fourth transistors.

The collectors and bases of the third and fourth transistors are connected to a circuit's ground potential gnd to provide a diode configuration. One end of the resistor R3 is connected to the emitters of the fourth transistors pnp1 through pnpm and the resistor R2 is connected to the other end thereof to provide or form a series configuration. One end of the resistor R1 is connected to the emitter of the third transistor pnp0. The other ends of the resistors R1 and R2 are connected to the drain of the driver MOSFET pm10 in common. And an emitter voltage Vbe1 of the third transistor and a potential at a connecting point of the resistors R3 and R2 are inputted to the differential amplifier circuit Amppd from which its output signal is fed back to the gate of the driver MOSFET pm10.

Since the differential amplifier circuit Amppd functions so as to make both input voltages equal to each other in the present embodiment, a voltage ΔVbe corresponding to a difference between a base-to-emitter voltage Vbe1 of the third transistor pnp0 and a base-to-emitter voltage Vbe2 of each of the fourth transistors pnp1 through pnpm is supplied to the resistor R3 to form an emitter current Ie2 corresponding to a constant current. A current generated from the driver MOSFET pm10 is supplied in such a manner that the current Ie2 and an emitter current Ie1 of the third transistor pnp0 become equal to each other with R1=R2. That is, the output voltage of the differential amplifier circuit Amppd is formed in such a manner that the drain current of the driver MOSFET pm10 is equally distributed to the third transistor pnp0 and fourth transistors pnp1 through pnpm.

In the temperature sensor circuit, a temperature signal Vtemp is defined as a temperature sense signal Vtsense with the drain of the driver MOSFET pm10 as a reference voltage Vbgr as expressed in the following equation (7). In the equation (7), R1=R2=R.

$$Vtemp=Vbgr-Vtsense=kT/q\cdot R/R3\cdot\ln(m) \quad (7)$$

Since the present temperature sensor circuit also takes a bandgap reference type circuit configuration having a feedback loop, it has a difference in potential relatively large like the temperature signal Vtemp at both ends of the resistor R2. Therefore, the temperature sensor circuit is capable of producing an output at, for example, double gain and outputting it as the temperature signal Vtemp. Thus, when an equal current is caused to simply flow through diodes different in emitter ratio, an error can be reduced as compared with a method for gain-doubling a small potential difference obtained from voltages that appear on their current injection sides by means of an amplifier.

The influence of the output voltage Vtemp on a variation in offset voltage Vos similar to the above, of the differential amplifier circuit Amppd can be expressed in the following equation (8):

$$dVtemp/dVos=R/R3+1/\ln(m) \quad (8)$$

If adequate numeric values are assumed as design values for the resistance values like, for example, R=R1=R2=800KΩ, R3=100kΩ, and m=23 in the equation (8), a variation is calculated as approximately 8.32. Thus, when consideration is given to only the offset voltage Vos similar to the above, of the differential amplifier circuit Amppd, the adoption of the circuit configuration like the temperature sensor circuit shown in FIG. 1 is effective in allowing the circuit to resist the influence of the offset voltage Vos.

Figure 4:
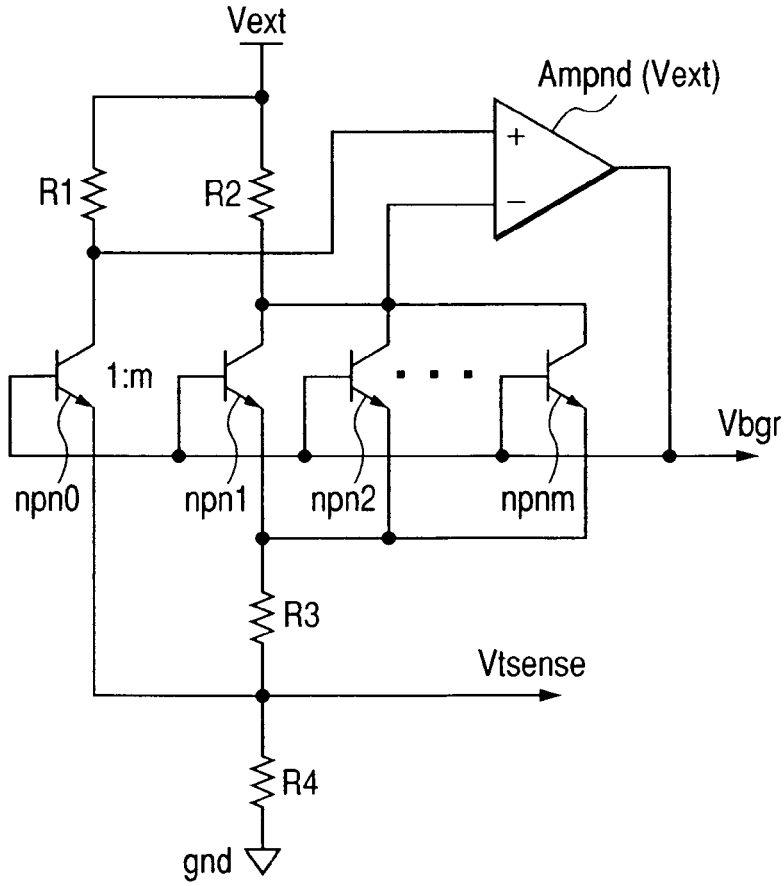
FIG. 4 is a circuit diagram depicting a further embodiment of a temperature sensor circuit according to the present invention.
Figure 5:
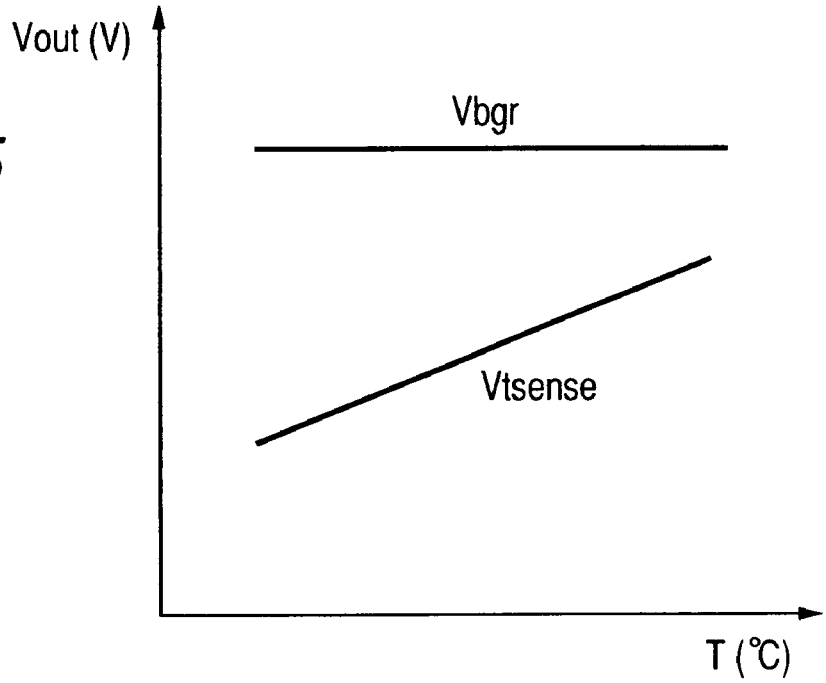
FIG. 5 is a characteristic diagram for describing the operation of the temperature sensor circuit shown in FIG. 4.

A circuit diagram of a further embodiment of a temperature sensor circuit according to the present invention is shown in FIG. 4. The present embodiment is a modification of the embodiment shown in FIG. 1. A signal outputted from a differential amplifier circuit Ampnd is used as a reference voltage Vbgr. The temperature sensor circuit according to the present embodiment forms both a reference voltage Vbgr and a temperature sense signal Vtsense. Thus, in order to obtain voltage characteristics Vbgr and Vtsense shown in FIG. 5, the ratio of resistors R3 to R4 is set to obtain the voltage characteristic Vbgr subjected to temperature compensation. Therefore, in exchange for the acquisition of the reference voltage Vbgr subjected to the temperature compensation, a temperature gradient included in Vtsense is uniquely determined corresponding to the temperature compensation of the voltage characteristic Vbgr.

Figure 6:
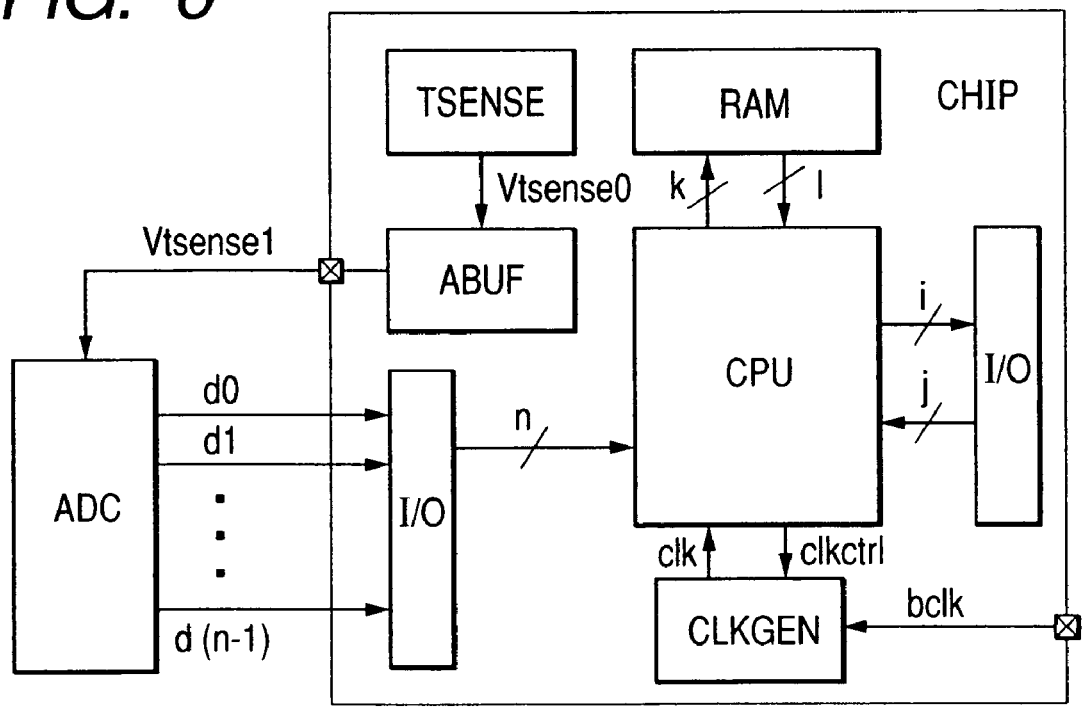
FIG. 6 is a block diagram showing one embodiment of a semiconductor integrated circuit equipped with a temperature sensor circuit according to the present invention.

A block diagram of one embodiment of a semiconductor integrated circuit equipped with a temperature sensor circuit according to the present invention is shown in FIG. 6. The present embodiment is directed toward a system LSI, and an external circuit is also shown together with it. The system LSI (chip) according to the present embodiment comprises a central processing unit CPU, a volatile memory RAM, a clock generator CLKGEN, an input/output interface I/O, and a circuit unillustrated in the same figure but having other additional function as needed. The central processing unit CPU and other circuit perform the transfer of digital signals therebetween. The clock generator CLKGEN is a circuit which generates an operation clock clk for the central processing unit CPU from a reference clock bclk supplied from the outside of the chip.

The present embodiment is provided with the function of monitoring the temperature in the system LSI as an in-chip temperature by means of the temperature sensor circuit TSENSE and varying the frequency of the operating clock clk supplied to the central processing unit CPU to thereby suppress a rise in temperature in the system LSI. In the present embodiment, a voltage Vtsense0 directly proportional to the temperature of the temperature sensor circuit TSENSE placed within the system LSI (chip) is therefore transferred to an A/D converter ADC placed outside the chip through an analog buffer ABUF as a voltage Vtsensel. The A/D converter ADC converts the voltage Vtsensel to digital signals d0 through d(n-1) of n bits. The so-converted temperature information do through d(n-1) are transferred to the central processing unit CPU through the input/output interface I/O. That is, the central processing unit CPU receives therein a digital value corresponding to the voltage Vtsense0 directly proportional to the temperature.

The central processing unit CPU generates a clock control signal clkctrl by reference to temperature information on the received digital value, and a table showing a suitable relationship between each predetermined temperature and a clock frequency, or information indicative of a target temperature range and transfers it to the clock generator CLKGEN. The clock generator CLKGEN changes the operating clock clk supplied to the central processing unit CPU in accordance with the clock control signal clkctrl. When, for example, the temperature becomes higher than a constant value, the clock generator CLKGEN controls the frequency of the operating clock clk low to reduce current consumption, thereby decreasing the temperature. When the temperature becomes lower than the constant value in reverse, the clock generator CLKGEN raises the frequency of the operating clock clk to increase current consumption, thereby making an operating speed fast.

Figure 7:
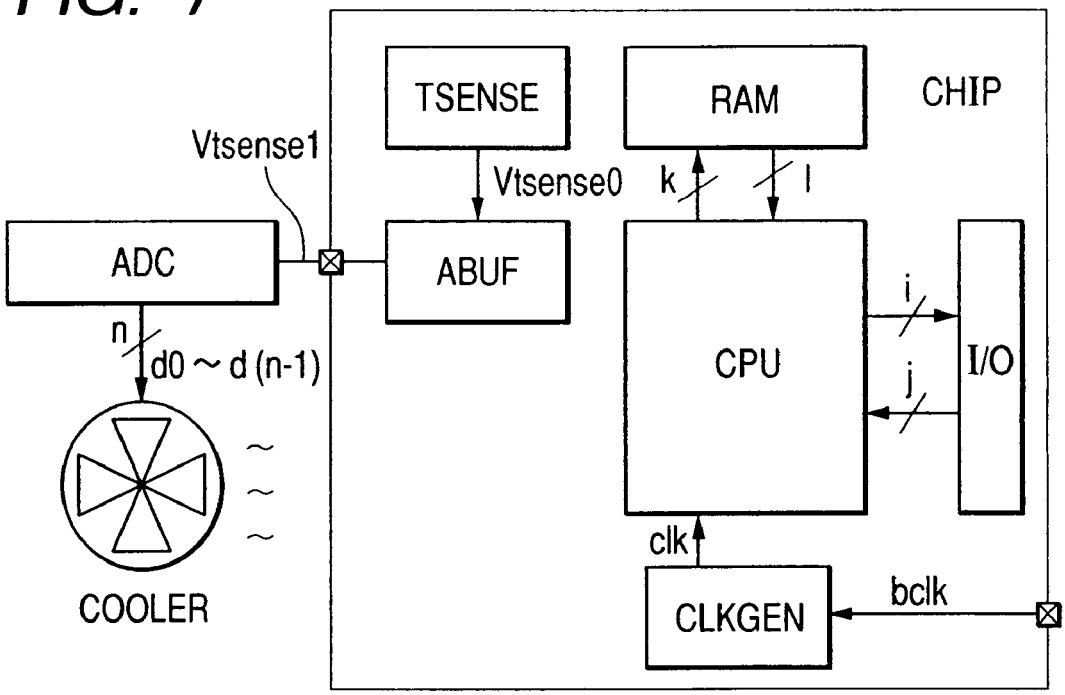
FIG. 7 is a block diagram illustrating another embodiment of a semiconductor integrated circuit equipped with a temperature sensor circuit according to the present invention.

A block diagram of another embodiment of a semiconductor integrated circuit equipped with a temperature sensor circuit according to the present invention is shown in FIG. 7. The present embodiment is a modification of the embodiment shown in FIG. 6, in which the temperature in a system LSI is monitored by the temperature sensor circuit TSENSE as an in-chip temperature and a voltage Vtsense0 directly proportional to the temperature is transferred to an A/D converter ADC placed outside the chip through an analog buffer ABUF as a voltage Vtsensel. The A/D converter ADC converts the voltage Vtsensel into digital signals do through d(n-1) of n bits. The so-converted temperature information do through d(n-1) are used for control of a cooler, COOLER. That is, the present embodiment brings about the effect that the cooling capacity of the COOLER is controlled according to the temperature of the chip equipped with the central processing unit to thereby make it possible to improve an operating limit for the chip and reduce a thermal influence on the periphery of the chip.

Figure 8:
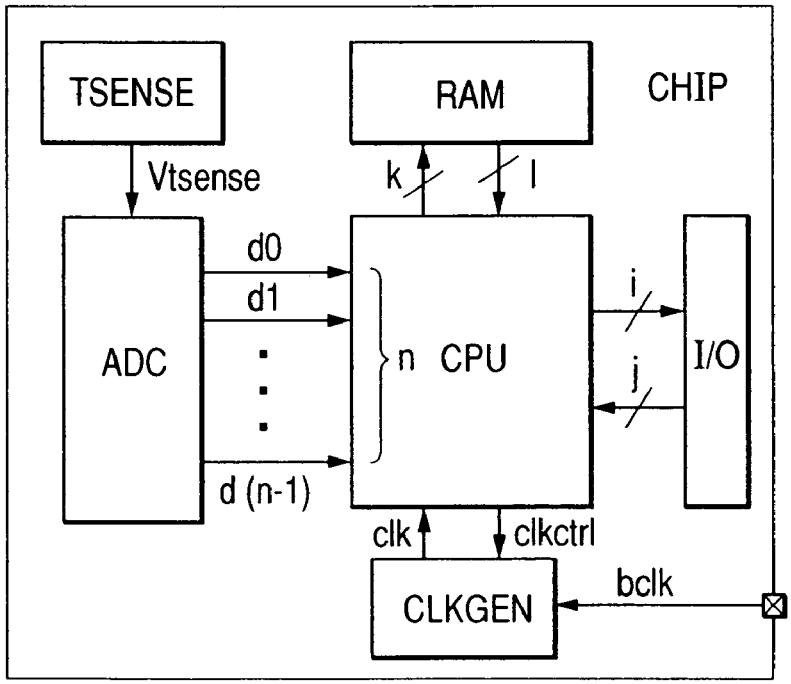
FIG. 8 is a block diagram depicting a further embodiment of a semiconductor integrated circuit equipped with a temperature sensor circuit according to the present invention.

A block diagram of a further embodiment of a semiconductor integrated circuit equipped with a temperature sensor circuit according to the present invention is shown in FIG. 8. The present embodiment is similar to the embodiment of FIG. 6 in that the temperature in a system LSI is monitored by the temperature sensor circuit TSENSE as an in-chip temperature and the frequency of an operating clock clk supplied to a central processing unit CPU is changed to suppress a rise in the temperature in the system LSI. In the present embodiment, the use of an A/D converter ADC in the system LSI makes unnecessary circuits of all or some of an analog buffer ABUF, an input/output interface I/O, an input/output terminal, etc.

Figure 9:
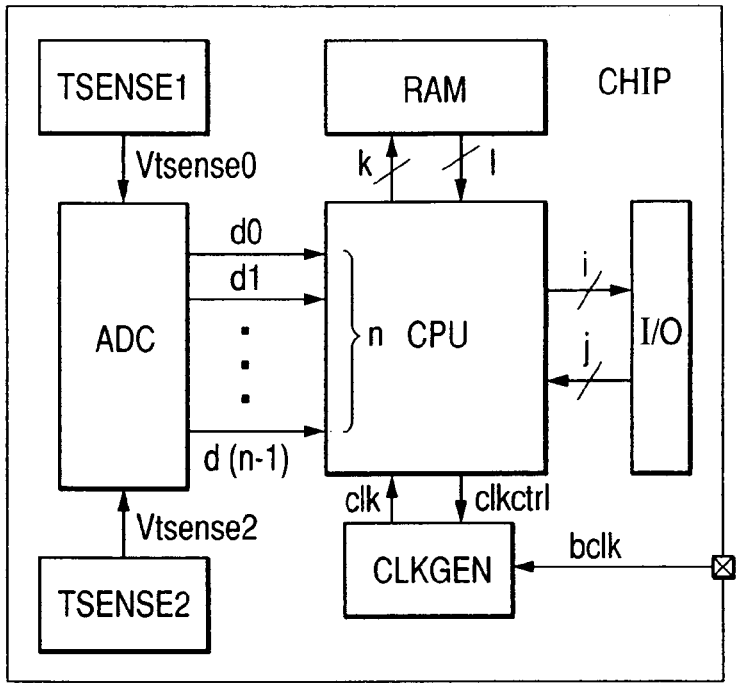
FIG. 9 is a block diagram showing a still further embodiment of a semiconductor integrated circuit equipped with temperature sensor circuits according to the present invention.

A block diagram of a still further embodiment of a semiconductor integrated circuit equipped with temperature sensor circuits according to the present invention is shown in FIG. 9. The present embodiment is similar to the embodiment of FIG. 8 in that the temperature in a system LSI is monitored as an in-chip temperature by means of each temperature sensor circuit TSENSE and the frequency of an operating clock clk supplied to a central processing unit CPU is changed to thereby suppress a rise in temperature in the system LSI. In the present embodiment, when the temperature in the chip is non-uniform, the temperature sensors are placed at several spots where a change in the temperature in the chip is sharp, and the operating clock of the system LSI is optimized on the basis of voltages obtained from the those temperature sensors. To this end, two temperature sensor circuits are provided like, for example, temperature sensor circuits TSENSE1 and TSENSE2, which monitor temperatures at the two spots where the change in temperature on the chip is sharp. The change in in-chip temperature is slower than the operation of an A/D converter ADC. Thus, the A/D converter ADC time-divisionally effects A/D-conversion processing on voltages Vtsense0 and Vtsense1 inputted from the temperature sensor circuits TSENSE1 nd TSENSE2.

Figure 10:
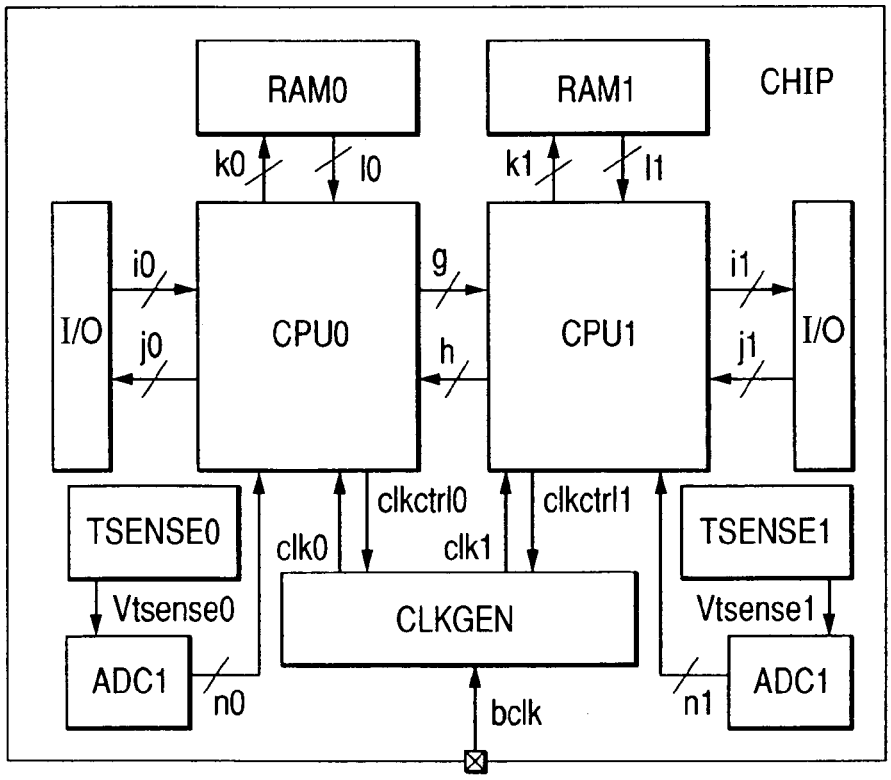
FIG. 10 is a block diagram illustrating a still further embodiment of a semiconductor integrated circuit equipped with temperature sensor circuits according to the present invention.

A block diagram of a still further embodiment of a semiconductor integrated circuit equipped with temperature sensor circuits according to the present invention is shown in FIG. 10. A system LSI (chip) according to the present embodiment has such a configuration that a plurality of central processing units are provided and operating clocks can also be set individually. A temperature sensor circuit TSENSE0 monitors a thermal change of a central processing unit CPU0, and a temperature sensor circuit TSENSE1 monitors a thermal change of a central processing unit CPU1. The frequencies of operating clocks clk0 and clk1 supplied in accordance with the states of heat generation of the central processing units CPU0 and CPU1 are separately changed to control the whole system LSI to the optimum operation. Incidentally, the placement of the temperature sensor circuits TSENSE0 and TSENSE1 within their corresponding central processing units. CPU0 and CPU1 or at spots where they are adjacent to each other makes it possible to monitor the temperatures accurately.

Figure 11:
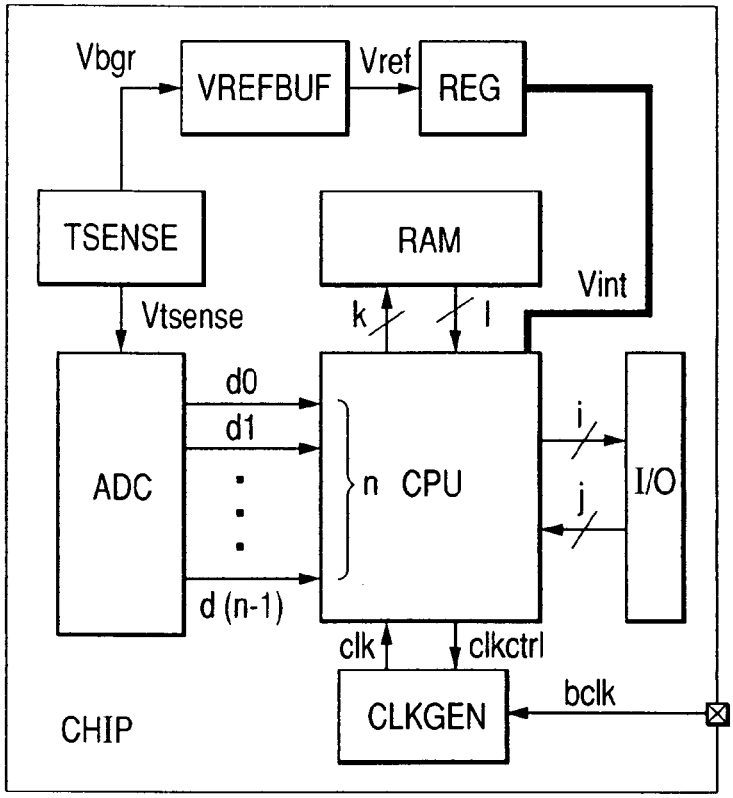
FIG. 11 is a block diagram showing a still further embodiment of a semiconductor integrated circuit equipped with a temperature sensor circuit according to the present invention.

A block diagram of a still further embodiment of a semiconductor integrated circuit equipped with a temperature sensor circuit according to the present invention is shown in FIG. 11. The present embodiment makes use of a function as a temperature sensor and a function as the generation of a reference voltage, using the temperature sensor circuit TSENSE shown in FIG. 4. A voltage directly proportional to the temperature in a chip is outputted as Vtsense and brought into digital form by an A/D converter ADC, followed by transfer to a central processing unit CPU, which in turn is used to control the frequency of an operating clock clk in a manner similar to the above. On the other hand, a voltage Vbgr small in temperature dependence is utilized as a reference voltage Vref for a deboost or step-down power circuit REG mounted in a system LSI. That is, the step-down power circuit REG generates an internal reference voltage Vref necessary for the central processing unit CPU through an interval voltage setting circuit VREF-BUF with the reference voltage Vbgr as a base and generates an internal power supply voltage Vin through an external power supply voltage Vext produced from an output means such as a series or switching regulator or the like on the basis of the reference voltage Vref, followed by supply to an internal circuit such as the CPU.

Figure 12:
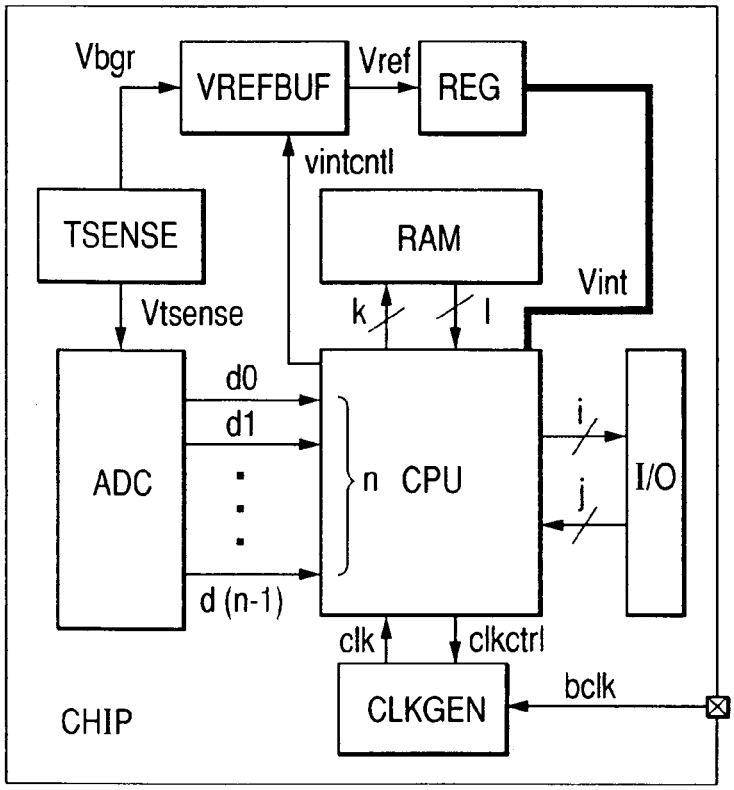
FIG. 12 is a block diagram illustrating a still further embodiment of a semiconductor integrated circuit equipped with a temperature sensor circuit according to the present invention.

A block diagram of a still further embodiment of a semiconductor integrated circuit equipped with a temperature sensor circuit according to the present invention is shown in FIG. 12. The present embodiment is equivalent to a modification of the embodiment shown in FIG. 11, wherein a central processing unit CPU receives therein temperature information d0 through d(n-1) formed by an A/D converter ADC on the basis of an output voltage Vtsense directly proportional to the temperature of the temperature sensor circuit TSENSE in a manner similar to the above and thereby generates an operating clock control signal clkctrl and an internal power-supply voltage control signal vintctrl. It is thus possible to optimize an operating clock clk and an internal power supply voltage Vint supplied to the central processing unit CPU itself. That is, the internal power-supply voltage control signal vintctrl is transferred to an internal voltage setting circuit VREFBUF, where an internal reference voltage Vref based on temperature monitor information is changed.

Figure 13:
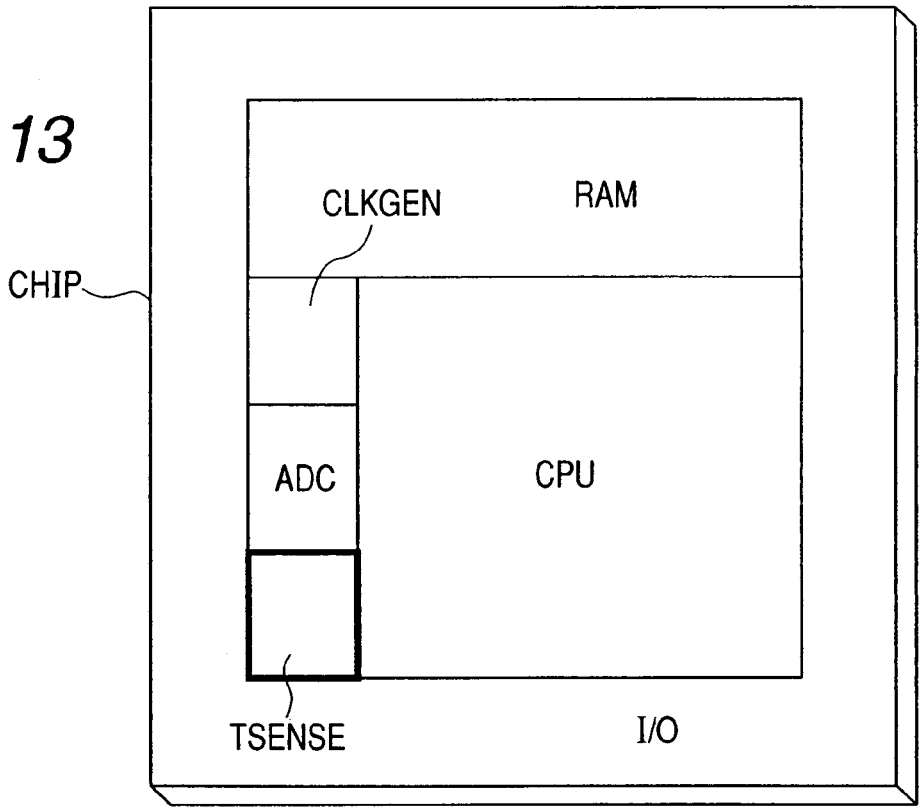
FIG. 13 is a schematic chip layout diagram depicting one embodiment of a semiconductor integrated circuit equipped with a temperature sensor circuit according to the present invention.

A schematic chip layout diagram of one embodiment of a semiconductor integrated circuit equipped with a temperature sensor circuit according to the present invention is shown in FIG. 13. A circuit configuration of a system LSI according to the present embodiment corresponds to FIG. 8. A temperature sensor circuit TSENSE is located within a chip and placed in an area for laying out analog circuits such as a clock generator CLKGEN, an A/D converter ADC, etc., and a circuit operated at an external power supply voltage Vext.

Figure 14:
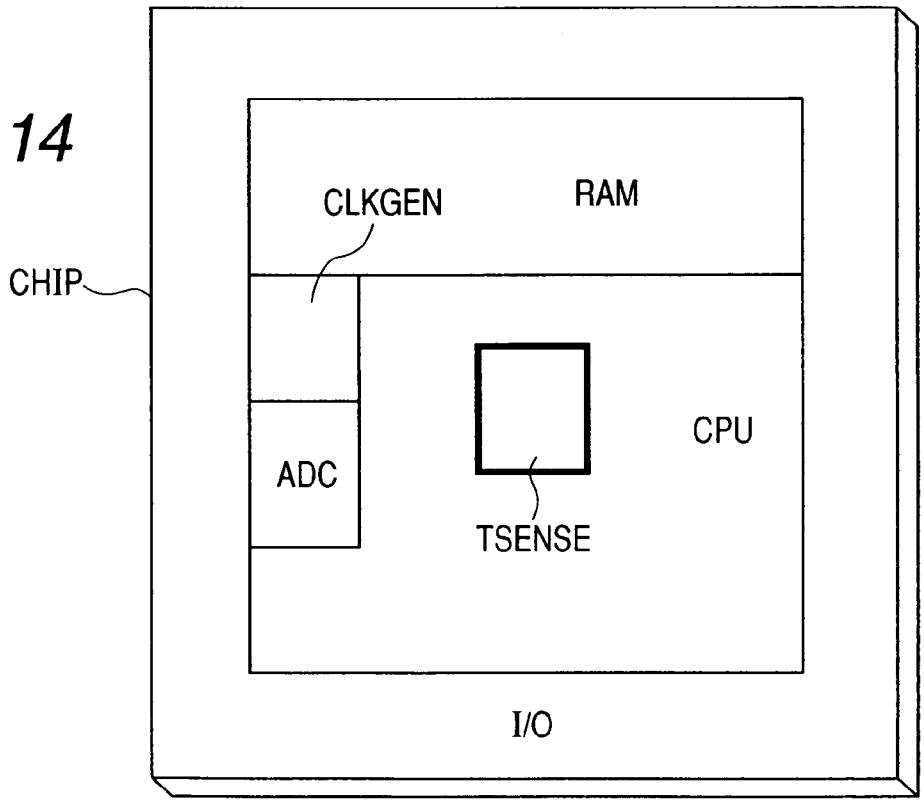
FIG. 14 is a schematic chip layout diagram illustrating another embodiment of a semiconductor integrated circuit equipped with a temperature sensor circuit according to the present invention.

A schematic chip layout diagram of another embodiment of a semiconductor integrated circuit equipped with a temperature sensor circuit according to the present invention is shown in FIG. 14. A circuit configuration of a system LSI according to the present embodiment is equivalent to one corresponding to FIG. 8. A temperature sensor circuit TSENSE is placed near a spot where it is considered in advance that a change in generated heat is sharp within the inside of a central processing unit CPU or the like. Thus, the operation of the system LSI (chip) can quickly be optimized by allowing the temperature sensor circuit to follow such a change in temperature as soon as possible.

Figure 15:
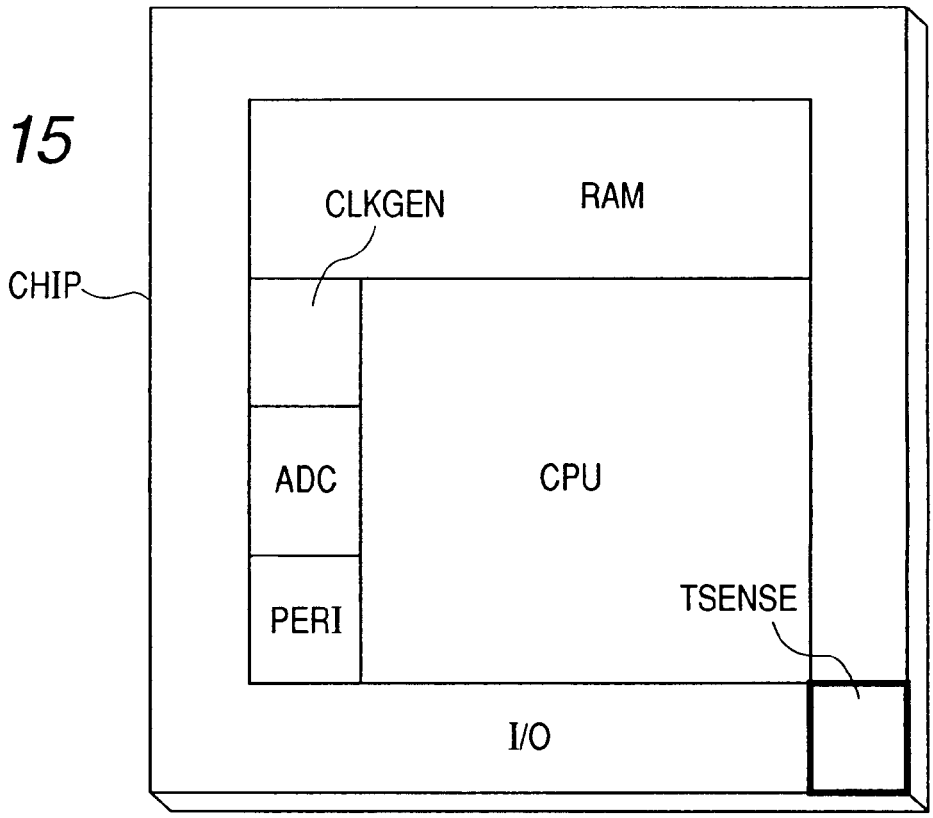
FIG. 15 is a schematic chip layout diagram showing a further embodiment of a semiconductor integrated circuit equipped with a temperature sensor circuit according to the present invention.

A schematic chip layout diagram of a further embodiment of a semiconductor integrated circuit equipped with a temperature sensor circuit according to the present invention is shown in FIG. 15. In a circuit configuration of a system LSI according to the present embodiment, a peripheral circuit PERI and the like necessary to provide added values for the system LSI are mounted in the system LSI (chip) equivalent to one corresponding to FIG. 8. Space enough to lay out a temperature sensor circuit TSENSE might not exist in the center of the chip in terms of the mounting of the peripheral circuit PERI and the like in the system LSI. In this case, the temperature sensor circuit TSENSE is placed in an area such as the corner or the like of the chip, which is unused in an area in which an input/output interface I/O and the like are disposed, whereby the corresponding temperature sensor can be disposed without an increase in the area of the chip.

Figure 16:
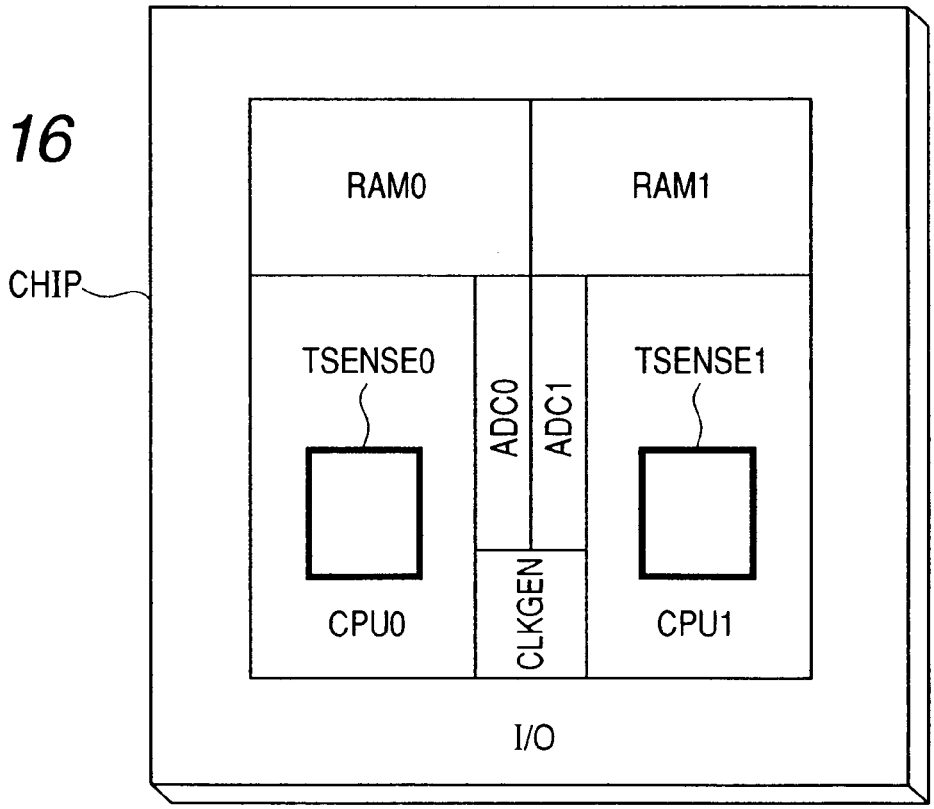
FIG. 16 is a schematic chip layout diagram depicting a still further embodiment of a semiconductor integrated circuit equipped with temperature sensor circuits according to the present invention.

A schematic chip layout diagram of a still further embodiment of a semiconductor integrated circuit equipped with temperature sensor circuits according to the present invention is shown in FIG. 16. A circuit configuration of a system LSI according to the present embodiment is equivalent to one corresponding to FIG. 10. When the system LSI has a plurality of central processing units in a manner similar to the above, a plurality of temperature sensors are also provided in like manner and monitor thermal changes of the respective central processing units CPUs, and the operation of the system LSI is optimized every central processing units CPUs. That is, temperature sensor circuits TSENSE0 and TSENSE1 are placed near spots where it is considered in advance that a change in the heat generated is sharp inside central processing units CPU0 and CPU1, for example, in a manner similar to the case of FIG. 14. Thus, the operation of the system LSI (chip) can more quickly be optimized at the central processing units CPU0 and CPU1 by allowing the temperature sensor circuits to follow such a change in temperature as soon as possible.

Figure 17:
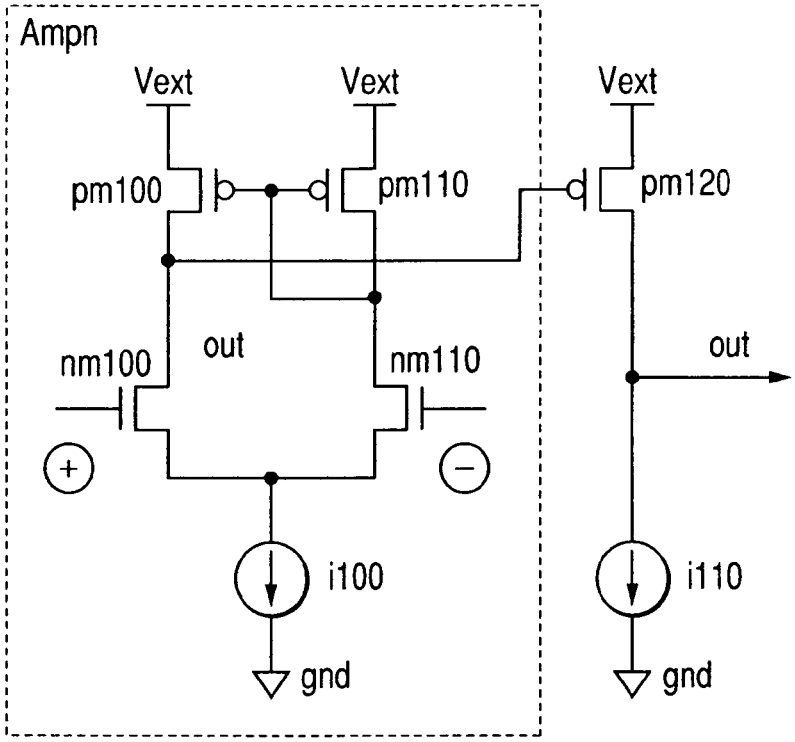
FIG. 17 is a circuit diagram showing one embodiment of a differential amplifier circuit employed in a temperature sensor circuit according to the present invention.

A circuit diagram of one embodiment of a differential amplifier circuit used in a temperature sensor circuit according to the present invention is shown in FIG. 17. The differential amplifier circuit Ampnd according to the present embodiment has a basic amplifier section Ampn comprising N channel MOS transistors nm100 and nm110 constituting a differential pair, and P channel type current mirror MOS transistors pm100 and pm110 for allowing an equal current to flow through those transistors of the differential pair. An output stage is constituted of a P channel type driver MOS transistor pm120 which receives therein a signal outputted from the basic amplifier section Ampn. A constant current source i100 determines an operating current of the basic amplifier section Ampn. The constant current source i100 gives a role for providing a load current for the driver MOS transistor pm120. The differential amplifier circuit of such a CMOS configuration has a relatively large offset voltage Vos due to the process variations in the threshold voltages of the MOS transistors nm100 and nm110, and the like as described above. However, the influence of the offset voltage Vos can be reduced by adoption of such a circuit configuration as described above.

Figure 18:
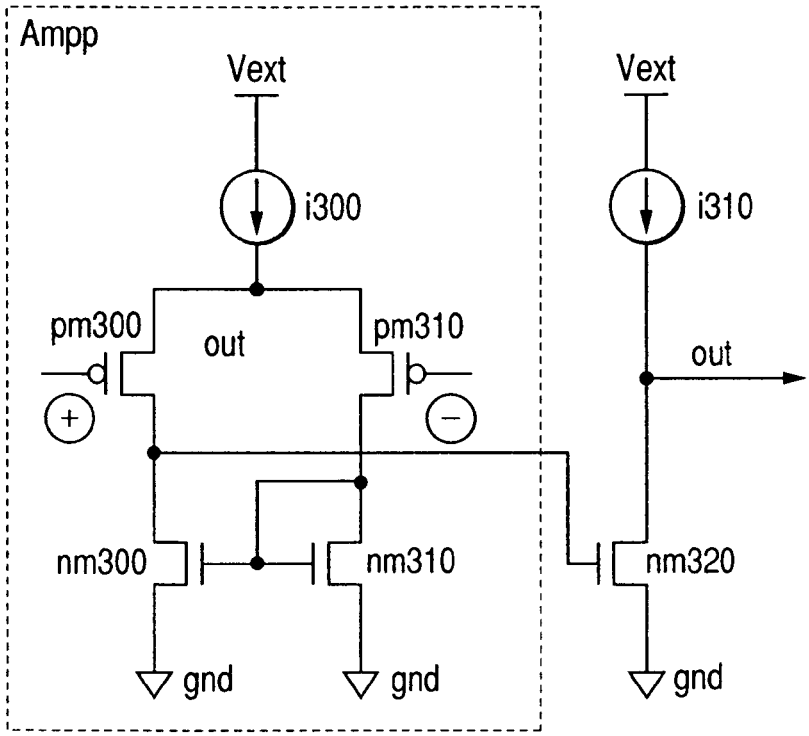
FIG. 18 is a circuit diagram illustrating another embodiment of a differential amplifier circuit employed in a temperature sensor circuit according to the present invention.

A circuit diagram of another embodiment of a differential amplifier circuit used in a temperature sensor circuit according to the present invention is shown in FIG. 18. The present embodiment is equivalent to one wherein the conduction type of each MOSFET shown in FIG. 17 is reversed. That is, the present embodiment is directed toward the differential amplifier circuit Amppd used in FIG. 3. A basic amplifier section Ampp is constituted of P channel MOS transistors pm300 and pm310 constituting a differential pair, and N channel type current mirror MOS transistors nm300 and nm310 for allowing an equal current to flow through those transistors of the differential pair. An output stage is constituted of an N channel type driver MOS transistor nm320 and a constant current source i310 used as a load. The constant current source i300 determines an operating current of the basic amplifier section Ampp.

Figure 19:
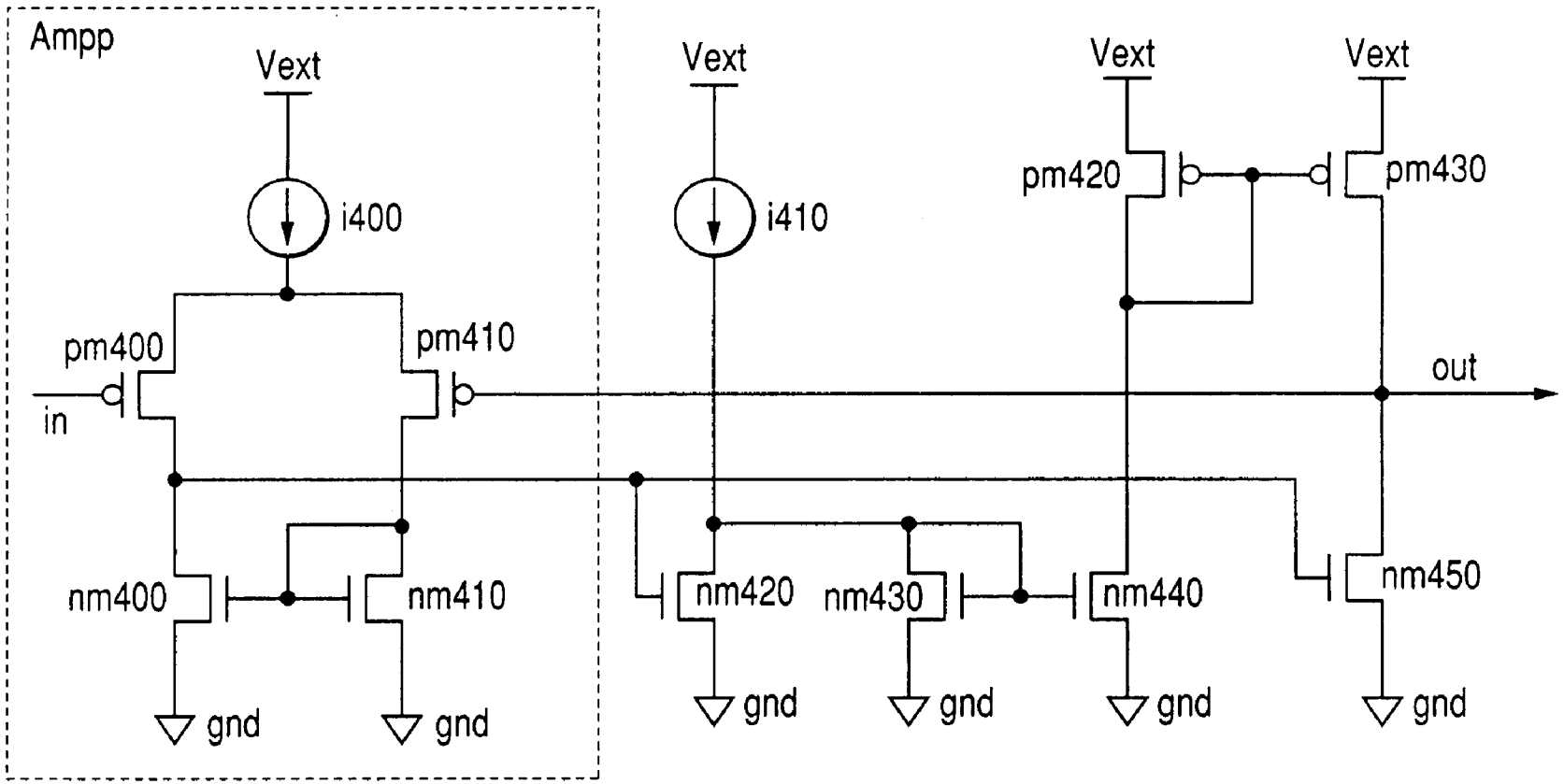
FIG. 19 is a circuit diagram showing one embodiment of an analog buffer circuit provided in a semiconductor integrated circuit according to the present invention.

A circuit diagram of one embodiment of an analog buffer provided in a semiconductor integrated circuit according to the present invention is shown in FIG. 19. The analog buffer ABUF according to the present embodiment is used in FIGS. 6 and 7 and the like. The analog buffer ABUF transfers an output Vtsense of a temperature sensor circuit TSENSE to an A/D converter ADC provided outside a system LSI as described above. The analog buffer ABUF is constituted of a basic amplifier section Ampp comprising P channel type MOS transistors pm410 and pm410 forming a differential pair, and N channel type current mirror MOS transistors nm400 and nm410 for allowing an equal current to flow through those transistors configured as the differential pair.

A driver section comprises P channel type MOS transistors pm420 and pm430 and N channel type MOS transistors nm420 and nm430, and nm440 and nm450. An output signal out of the driver section is fed back 100% to the basic amplifier section Ampp so that a voltage follower circuit is configured. A voltage supplied to an input in is current-amplified and outputted as an output voltage. A constant current i400 determines an operating current for the basis amplifier section Ampp, and a constant current source i410 determines an operating current for the driver section.

Figure 20:
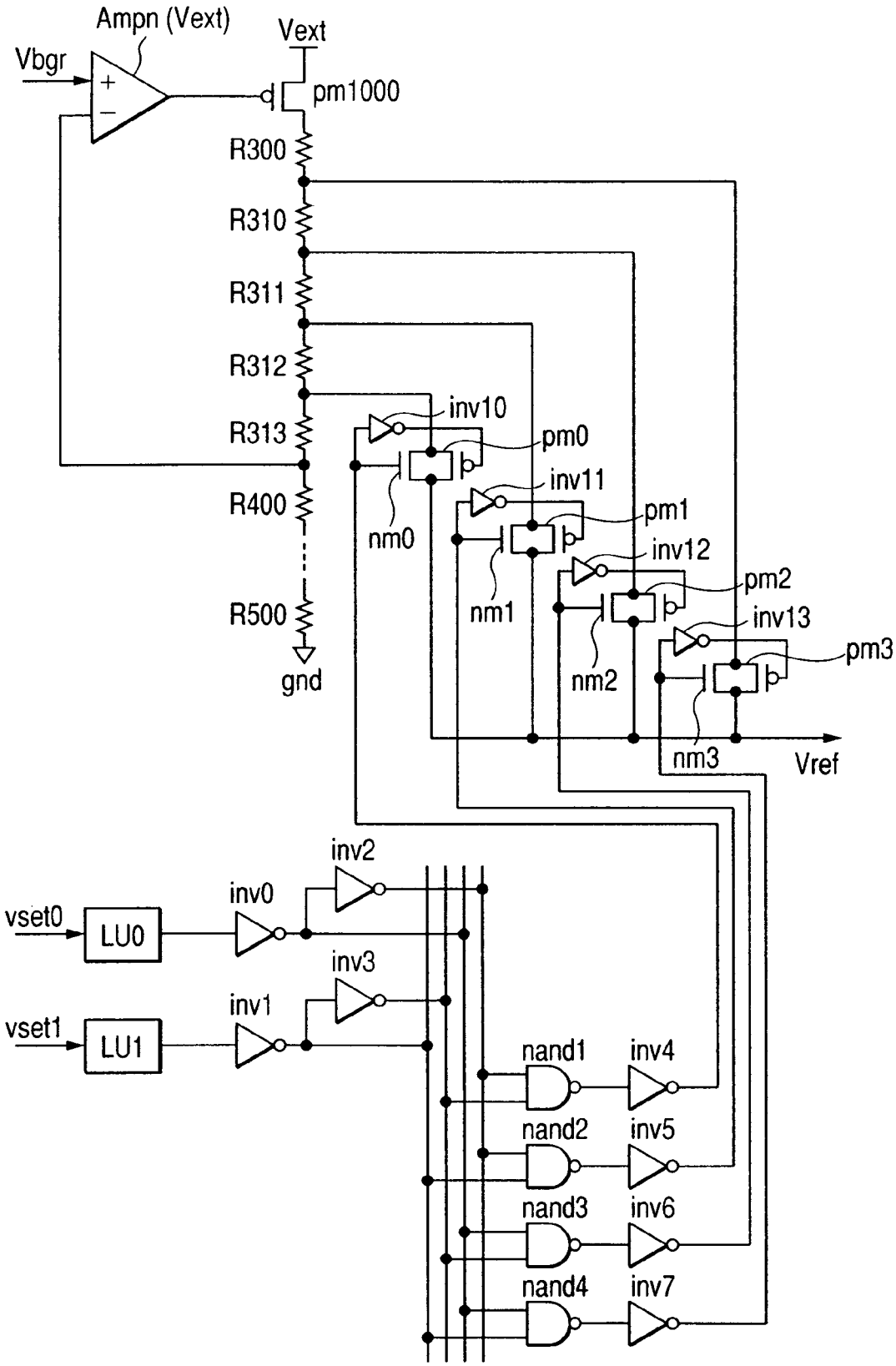
FIG. 20 is a circuit diagram illustrating one embodiment of an internal voltage setting circuit mounted in a semiconductor integrated circuit according to the present invention.

A circuit diagram of one embodiment of an internal voltage setting circuit mounted in a semiconductor integrated circuit according to the present invention is shown in FIG. 20. The internal voltage setting circuit VREFBUF according to the present embodiment is used in FIGS. 11 and 12. The internal voltage setting circuit VREFBUF is used to generate a reference voltage Vref necessary to supply an operating voltage VVint to its corresponding central processing unit CPU on the basis of the reference voltage Vbgr small in temperature dependence, which is obtained from the temperature sensor circuit TSENSE as shown in FIG. 4.

A basic circuit configuration of the internal voltage setting circuit VREFBUF corresponds to a basic amplifier section Ampn, a driver MOS transistor pm1000, and resistors R300 through R313, R400 and R500. Reference voltage set signals vset0 and vset1 sent from the central processing unit CPU or the like are converted to power supply voltage Vext levels through level shifters LU0 and LU1. Based on those converted into the power supply voltage Vext levels, reference voltages Vref can be switched by pass gates nm0 and pm0 comprised of parallel-configured P channel and N channel MOS transistors, and the like through inverters inv0 through inv13 and logic circuits such as NAND gates nand1 through nand4.

Figure 21:
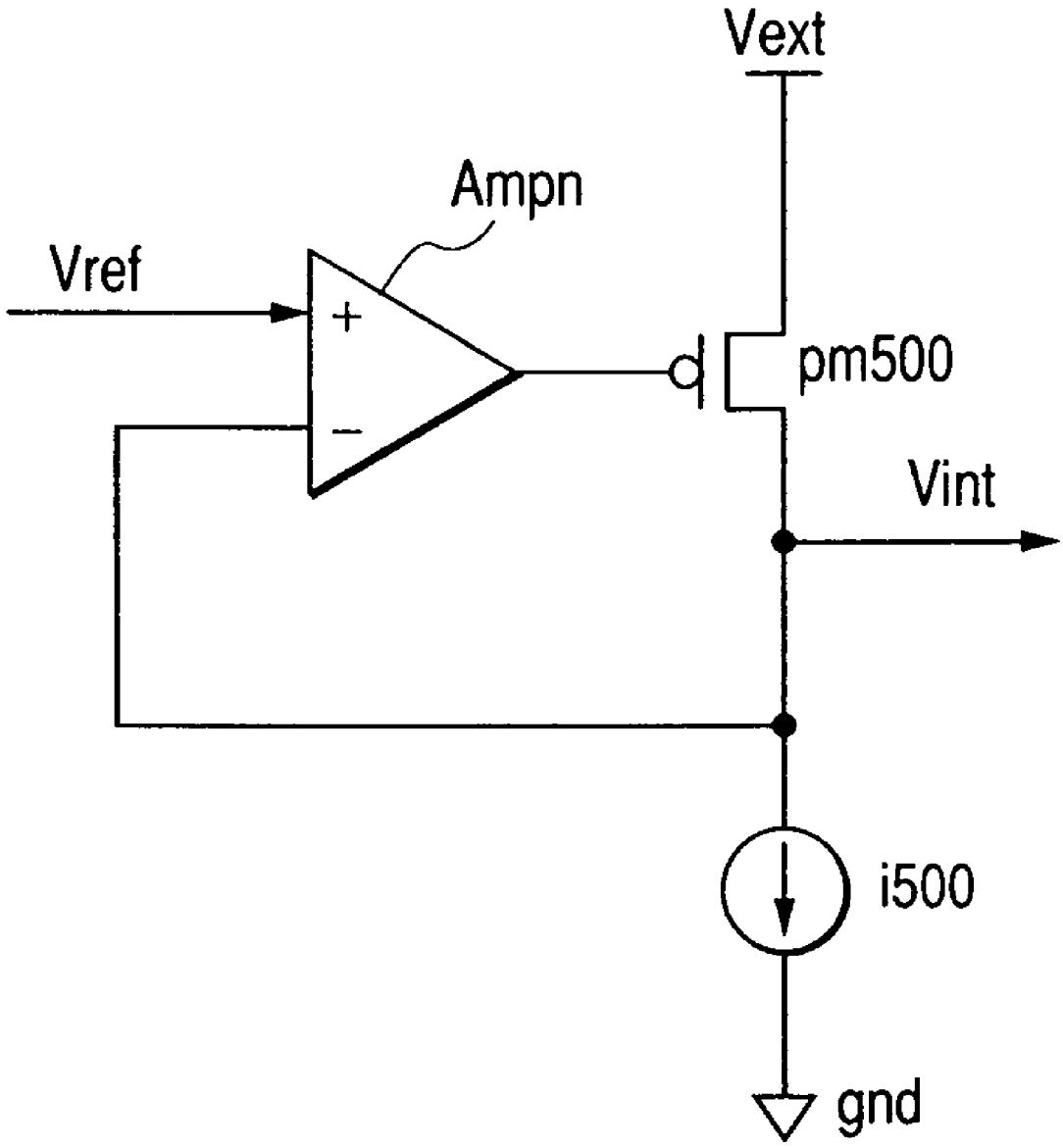
FIG. 21 is a circuit diagram showing one embodiment of a regulator mounted in a semiconductor integrated circuit according to the present invention.

A circuit diagram showing one embodiment of a regulator mounted in a semiconductor integrated circuit according to the present invention is shown in FIG. 21. The regulator according to the present embodiment comprises a basic amplifier section Ampn, a driver MOS transistor pm500 and a load current source i500. The series regulator supplies a voltage Vint stepped down from an external power supply voltage Vext, using the reference voltage Vref corresponding to the output voltage of the internal voltage setting circuit VREFBUF shown in FIG. 20.

Figure 22:
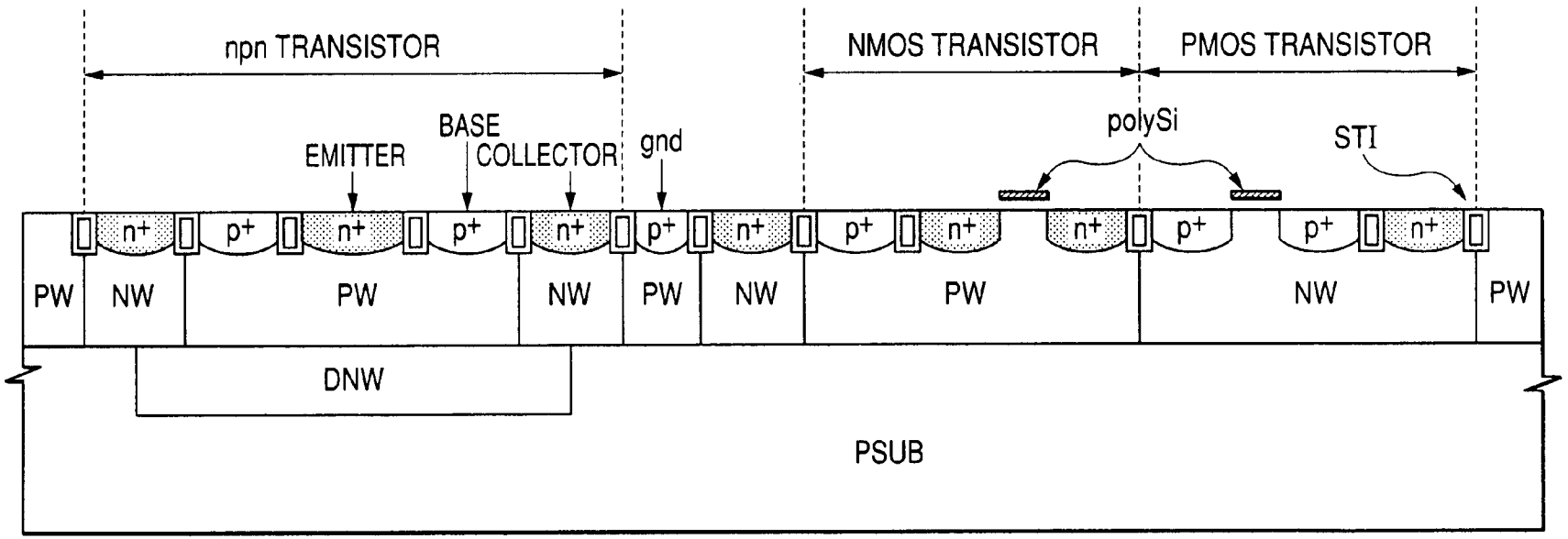
FIG. 22 is a schematic device sectional view showing one embodiment of a semiconductor integrated circuit according to the present invention.

A schematic device sectional view showing one embodiment of a semiconductor integrated circuit according to the present invention is shown in FIG. 22. In the same figure, npn type bipolar transistors constituting the first and second transistors that constitute the temperature sensor circuit, and a P channel type MOS transistor and an N channel type MOS transistor constituting the differential amplifier circuit Ampnd or the like are illustratively shown.

These bipolar transistors and MOS transistors are formed by a CMOS process. The npn type bipolar transistor npn0 or the like is constituted of a substrate type structure having an emitter region based on n+, corresponding to each of source and drain regions of the N channel MOS transistor, a base region based on p+ and a P well PW corresponding to a substrate gate (channel section), and a collector region comprising n+, an N well NW for isolation and a deep N well DNW, which correspond to the source and drain regions. Although a p type substrate PSUB is generally supplied with a ground potential gnd, a potential other than one for the p type substrate PSUB can be supplied as a collector potential unlike a parasitic pnp bipolar transistor of a substrate type. That is, the present circuit configuration can be provided as such a circuit configuration that each transistor is connected to the resistors R1 and R2 as shown in FIG. 1. Incidentally, the respective n+ and p+ regions are isolated by STI (Shallow Trench Isolation). In the above npn transistor, although not restricted in particular, the base thereof is formed so as to surround its emitter and the collector thereof is formed so as to surround the base.

The N channel MOS transistor is configured in such a manner that the n+ regions formed in the P well PW are defined as its source and drain, and a gate electrode constituted of polysilicon polySi is provided on a semiconductor region interposed therebetween through a gate insulating film interposed therebetween. The P well PW is provided with p+ and supplied with a bias voltage (well voltage). The P channel MOS transistor is configured in such a manner that the p+ regions formed in the N well NW are defined as its source and drain, and a gate electrode constituted of polysilicon polySi is provided on a semiconductor region interposed therebetween through a gate insulating film interposed therebetween. The N well NW is provided with n+ and supplied with a bias voltage (well voltage).

Figure 23:
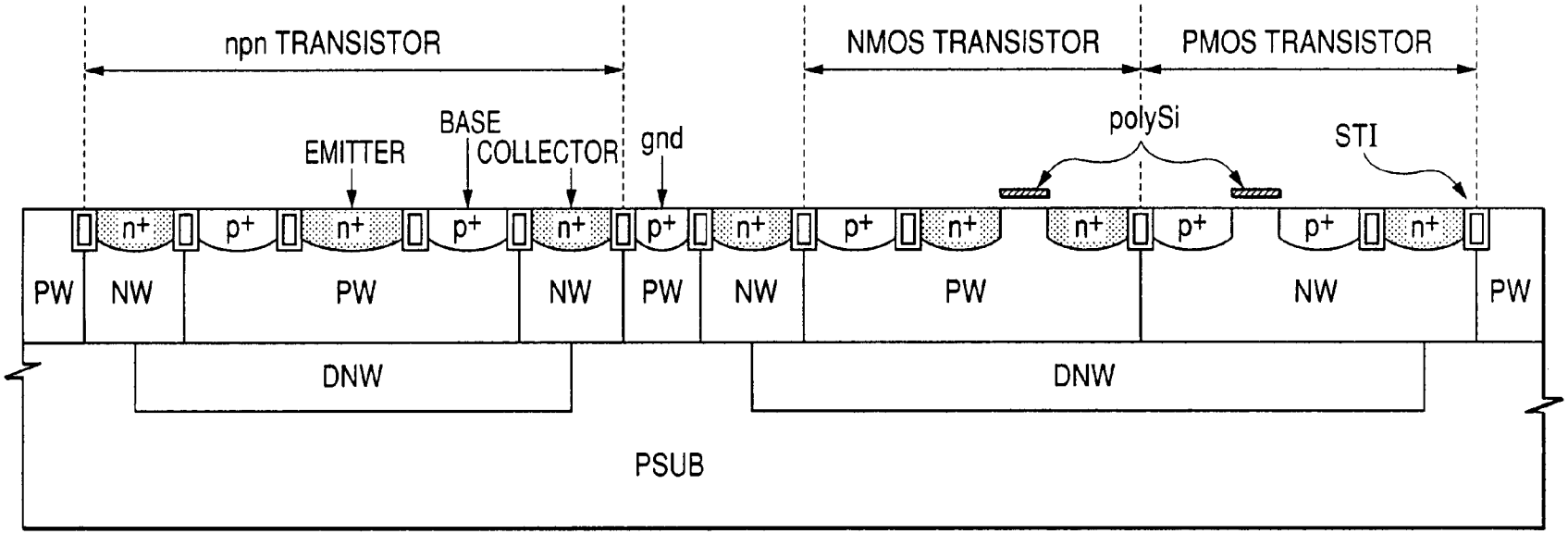
FIG. 23 is a schematic device sectional view illustrating another embodiment of a semiconductor integrated circuit according to the present invention.

A schematic device sectional view illustrating another embodiment of a semiconductor integrated circuit according to the present invention is shown in FIG. 23. The present embodiment is a modification of FIG. 22. A deep N well DNW is provided in a forming region of each MOS transistor. It is thus possible to reduce noise suffered from a substrate. A well PW for the N channel MOS transistor is electrically isolated from the substrate PSUB. Thus, when the MOS transistors are used as such differential MOS transistors nm10 and nm110 as shown in FIG. 17 by way of example, an increase in effective threshold voltage due to a substrate effect can be prevented by connecting the well to the sources thereof. Incidentally, bipolar transistors are similar to those shown in FIG. 22.

Figure 24:
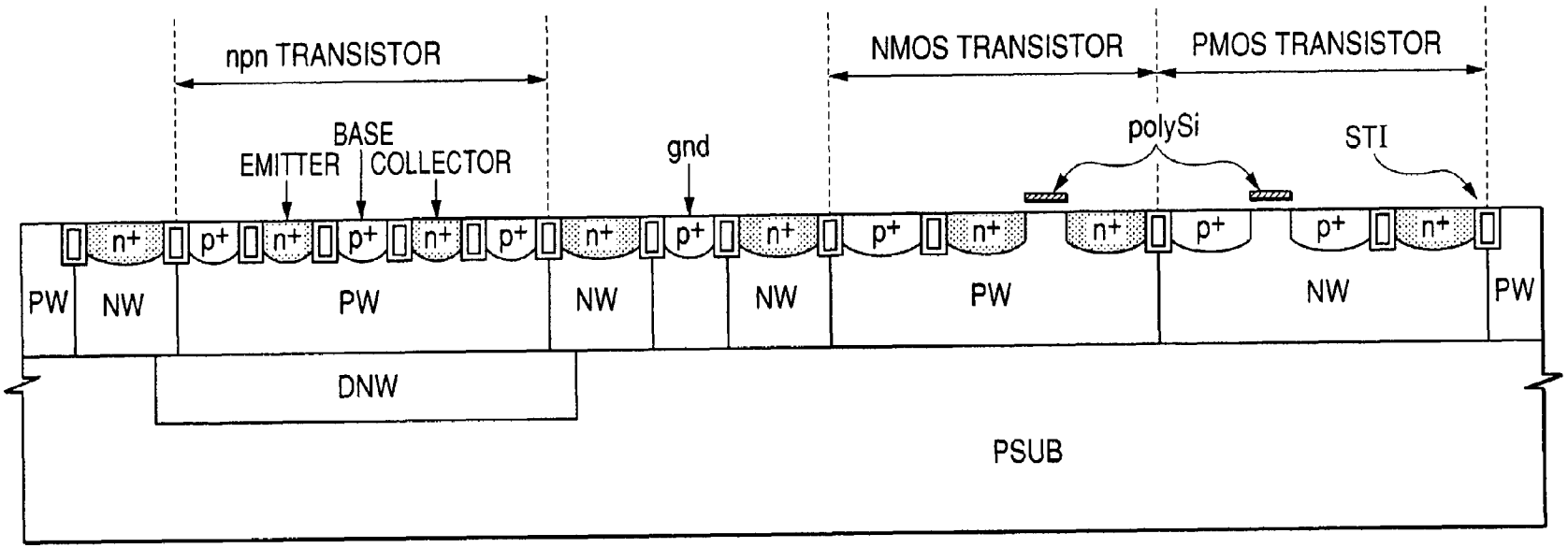
FIG. 24 is a schematic device sectional view depicting a further embodiment of a semiconductor integrated circuit according to the present invention.

A schematic device sectional view depicting a further embodiment of a semiconductor integrated circuit according to the present invention is shown in FIG. 24. In the present embodiment, each bipolar transistor is configured as a lateral type structure having an emitter region based on an n+ region similar to the above, a base region constituted of p+ and a P well PW, and a collector region constituted of an n+ region. In a CMOS process, control on an impurity density in a horizontal direction is generally difficult as compared with its control in a vertical direction. The lateral type structure has a tendency to increase a variation in the characteristic of each bipolar transistor as compared with the substrate types shown in FIGS. 22 and 23.

While the invention made above by the present inventors has been described specifically on the basis of the preferred embodiments, the present invention is not limited to the embodiments referred to above. Various changes can be made thereto within the scope not departing from the gist thereof. In addition to the case in which the same current is caused to flow through the first and second transistors and the difference between current densities is provided according to an area ratio as in the above embodiment, for example, the first and second transistors are set to the same size and the emitter currents may be caused to flow therethrough at a constant ratio. An area ratio and a current ratio may be utilized in combination. The present invention can widely be used in a temperature sensor circuit mounted in a semiconductor integrated circuit formed in a CMOS process, and various semiconductor integrated circuits each having a circuit built therein, which is formed for reference voltage generation.

What is claimed is:

1. A semiconductor integrated circuit comprising a temperature sensor circuit, the temperature sensor circuit including:

a first transistor having a collector supplied with a first potential and an emitter through which a first current flows;

a plurality of transistors having collectors supplied with the first potential and each of which has a same emitter size as the first transistor, emitters of the plurality of transistors being connected in common, collectors of the plurality of transistors being connected in common, bases of the plurality of transistors connected in common, a first resistor having one end connected to the emitters of the plurality of transistors;

a second resistor connected in series with the first resistor;

a third resistor having one end connected to the emitter of the first transistor;

a first MOSFET provided between another end of the second resistor and another end of the third resistor, and a second potential different from the first potential; and a differential amplifier circuit of a CMOS configuration, which receives an emitter voltage of the first transistor and a voltage of a connecting point of the first resistor and the second resistor, and forms an output voltage such that both voltages become equal, and which supplies the output voltage to a gate of the first MOSFET, wherein said temperature sensor circuit forms a temperature sense voltage from both ends of the sixth resistor.

2. A semiconductor integrated circuit comprising a temperature sensor circuit, the temperature sensor circuit including:

a first transistor which allows a first current to flow through an emitter thereof;

a plurality of transistors each of which has a same emitter size is same as the first transistor, emitters of the plurality of transistors being connected in common, collectors of the plurality of transistors being connected in common, bases of the plurality of transistors being connected in common, a first resistor provided between the emitter of the first transistor and the emitters of the plurality of transistors;

a second resistor provided between the emitter of the first transistor and a circuit ground potential;

a third resistor provided between a collector of the first transistor and a power supply voltage;

a fourth resistor provided between collectors of the plurality of transistors and the power supply voltage; and a differential amplifier circuit which receives a collector voltage of the first transistor and a collector voltage of each of the plurality of transistors, and forms an output voltage such that both become equal, and which supplies the output voltage to bases of the first transistor and the plurality of transistors, wherein said temperature sensor circuit forms a temperature sense voltage from a connecting point of the first and second resistors.

3. The semiconductor integrated circuit according to claim 2, wherein a temperature gradient of the temperature sense voltage is set in accordance with a resistance ratio between the first resistor and the second resistor.

4. The semiconductor integrated circuit according to claim 2, wherein the differential amplifier circuit includes a CMOS circuit, and wherein the first transistor and the plurality of transistors are npn transistors configured using semiconductor regions formed in a process of forming the CMOS circuit constituting the differential amplifier circuit.

5. The semiconductor integrated circuit according to claim 4, wherein the resistance ratio between the first resistor and the second resistor is set such that a voltage outputted from the differential amplifier circuit does not have temperature dependence, and wherein the output voltage of the differential amplifier circuit is used as a reference voltage.

6. The semiconductor integrated circuit according to claim 4, further comprising a buffer circuit which generates an output through an external terminal in response to the temperature sense voltage.

7. The semiconductor integrated circuit according to claim 6, further comprising an input circuit which receives digitized temperature information formed based on the temperature sense voltage outputted through the buffer circuit, and a digital signal processing circuit which receives the temperature information through the input circuit.

8. The semiconductor integrated circuit according to claim 2, further comprising a CMOS circuit having a second conduction type well region and a first conduction type well region formed in a semiconductor substrate of a first conduction type, a first conduction type MOSFET formed in the second conduction type well region, and a second conduction type MOSFET formed in the first conduction type well region, wherein each of the first transistor and the plurality of transistors is a bipolar transistor of a lateral structure operated in a manner in which diffusion layers formed in a process for forming source and drain diffusion layers of the second conduction type MOSFET of the CMOS circuit are used as a collector and an emitter, and the first conduction type well region formed with the diffusion layers used as the collector and emitter is used as a base.

9. The semiconductor integrated circuit according to claim 2, further comprising a CMOS circuit having a second conduction type well region and a first conduction type well region formed in a semiconductor substrate of a first conduction type, a first conduction type MOSFET formed in the second conduction type well region, a second conduction type MOSFET formed in the first conduction type well region, and a second conduction type well region of deep depth for electrically isolating the first conduction type well region formed with the second conduction type MOSFET from the semiconductor substrate of the first conduction type, wherein each of the first transistor and the plurality of transistors is a bipolar transistor of a vertical structure in which a second conduction type diffusion layer formed in a process for forming source and drain diffusion layers of the first conduction type MOSFET of the CMOS circuit is used as an emitter, the first conduction type well region formed with the second conduction type diffusion layer constituting the emitter is used as a base, and the second conduction type well region provided to electrically isolate the first conduction type well region constituting the base from the semiconductor substrate of the first conduction type is used as a collector.

10. The semiconductor integrated circuit according to claim 2, further comprising a CMOS circuit having a second conduction type well region and a first conduction type well region formed in a semiconductor substrate of a second conduction type, a first conduction type MOSFET formed in the second conduction type well region, and a second conduction type MOSFET formed in the first conduction type well region, wherein each of the first transistor and the plurality of transistors is a bipolar transistor of a lateral structure operated in a manner in which diffusion layers formed in a process for forming source and drain diffusion layers of the second conduction type MOSFET of the CMOS circuit are used as a collector and an emitter, and the first conduction type well region formed with the diffusion layers used as the collector and emitter is used as a base.

11. The semiconductor integrated circuit according to claim 2, further comprising an A/D converter which forms digitized temperature information in response to the temperature sense voltage, and a digital signal processing circuit which receives the temperature information.

12. The semiconductor integrated circuit according to claim 11, wherein the temperature sensor circuit is provided in plural form, and wherein the A/D converter is used in common with the plurality of temperature sensor circuits.

13. The semiconductor integrated circuit according to claim 11, wherein the digital signal processing circuit is provided in plural form, and wherein the temperature sensor circuit and the A/D converter are provided in plural form in one-to-one correspondence with the digital signal processing circuits.

* * * * *